US005596867A

United States Patent [19]

Davis

[11] Patent Number: 5,596,867

[45] Date of Patent: Jan. 28, 1997

[54] CUTOFF ASSEMBLY FOR A FORM FILL AND SEAL PACKAGING MACHINE

[75] Inventor: Steven D. Davis, Yucaipa, Calif.

[73] Assignee: Winpak Lane, Inc., San Bernardino, Calif.

[21] Appl. No.: 547,769

[22] Filed: Oct. 25, 1995

[51] Int. Cl.[6] ..... B65B 9/20; B65B 61/06

[52] U.S. Cl. ..... 53/554; 53/389.3; 83/583; 83/699.41

[58] Field of Search ..... 53/551, 554, 389.3; 83/699.41, 583

[56] References Cited

U.S. PATENT DOCUMENTS

| | | | |
|---|---|---|---|
| 1,139,572 | 5/1915 | Perry | 83/583 X |
| 3,148,575 | 9/1964 | Thyng | 83/699.41 X |
| 3,196,724 | 7/1965 | Frank | 83/583 X |
| 3,289,388 | 12/1966 | Aubin | 53/551 |
| 3,661,488 | 5/1972 | Latreille | 83/583 X |
| 3,738,080 | 6/1973 | Reil | 53/551 |
| 4,265,074 | 5/1981 | Reuter et al. | 53/551 |
| 4,768,330 | 9/1988 | Lane, Jr. et al. . | |
| 4,845,926 | 7/1989 | Davis . | |
| 4,996,819 | 3/1991 | Davis . | |
| 5,016,426 | 5/1991 | Davis | 53/554 |
| 5,255,588 | 10/1993 | Foos et al. | 83/699.41 X |
| 5,408,807 | 4/1995 | Lane, Jr. et al. . | |

*Primary Examiner*—Horace M. Culver
*Attorney, Agent, or Firm*—James G. O'Neill

[57] ABSTRACT

A cutoff assembly for a form, fill and seal packaging machine having a fixed blade and a floating movable blade. The movable blade is adjustable horizontally with respect to the machine and the fixed blade so as to accurately cut off formed pouches, passing downwardly, in the vertical direction, through the machine.

16 Claims, 2 Drawing Sheets

CUTOFF ASSEMBLY FOR A FORM FILL AND SEAL PACKAGING MACHINE

BACKGROUND OF THE INVENTION

1. Field of the Invention

This invention relates generally to packaging machines for forming, filling and sealing flexible pouches, and more particularly, to an improved cutoff assembly for such machines.

2. Description of the Related Art

Because of the technical advances in film pouch forming, filling and sealing machines, more and more food and related products, in various states are being packaged in flexible film pouches for ease in shipping, handling and dispensing of such products at a point of use. Known machines to form, fill and seal such pouches usually utilize continuous rolls of heat sealable plastic film, and pouches are generally horizontally or vertically formed in continuous strips from the rolls of plastic film, filled with product, sealed, and then cutoff in a continuous process.

In such known packaging machines which form pouches vertically, i.e., traveling from the top down toward the bottom of the machine, a plurality of streams of formed lower pouches are severed from upper pouches formed from moving streams of front and back heat sealable films by some type of cutoff means at the lower end of the machine, and discharged from the machine at this lower end. The machine is then indexed and the cycle continues. Examples of such vertical packaging machines are disclosed in U.S. Pat. Nos. 4,768,330, 4,845,926, 4,996,819, 5,016,426 and 5,408,807, all of which cover machines produced by W. A. Lane, Inc. of San Bernardino, Calif.

As further discussed in these W. A. Lane patents, the separate cutoff or severing means for the formed pouches, must extend horizontally across the width of the machine and the vertical streams of material being formed, filled and sealed so as to be capable of simultaneously cutting off the formed lower pouches in each of the vertical streams of material.

However, although existing cutoff means work well, they do have numerous drawbacks and/or problems, such as when cutting hard to cut packaging materials, when operating at high speeds, or when environmental conditions such as humidity, temperature, or the like, change. Additionally, over extended periods of use almost all cutoff systems require adjustment, realignment or replacement because of wear and related factors. When known cutoff means become misaligned or wear down, the packaging machines must be stopped and the entire cutoff means either readjusted or replaced. This usually requires special tools, and extended periods of downtime for such machines. Furthermore, in known machines, depending on the materials being cut and the speed of the machines, the known cutoff means quickly become out-of-register, thereby forming unaesthetic and/or unusable pouches. These unusable pouches must be thrown away, resulting in loss of product and waste of materials.

Since known cutoff means have no easy adjusting or aligning mechanisms, much time and effort must be spent in either the readjustment or replacement of the entire cutting means. The resulting downtime of the machine is costly, and can cause shortages and other related problems for the machine user and its customers. Therefore, there exists a need in the package and dispensing art for a cutoff means which may be easily and quickly adjusted, at least in one dimension, and which overcomes the above set drawbacks, as well as other problems, and which may be easily fitted to existing machinery, or integrated into new machines during manufacture.

SUMMARY OF THE INVENTION

Accordingly, it is a general object of the present invention to provide an improved cutoff assembly means for a form, fill and seal packaging machine. It is a more particular object of the present invention to provide an adjustable cutoff assembly means for a form, fill and seal packaging machine. It is a further object of the present invention to provide a novel cutoff assembly means, having a plurality of adjusting means, for a form, fill and seal packaging machine. It is yet another object of the present invention to provide a novel cutoff assembly means for a vertical form, fill and seal packaging machine in which a cutoff blade thereof is adjustable in a horizontal plane. It is a still further object of the present invention to provide a novel cutoff assembly means having a plurality of blades for a vertical form, fill and seal packaging machine, in which only one of the blades is adjustable in the horizontal direction. And, it is yet a still further object of the present invention to provide a novel cutoff assembly means for a vertical form, fill and seal packaging machine in which the cutoff assembly has a pair of blades with one of the pair being fixed, while the other of such blades is floatable and adjustable in the horizontal direction.

In accordance with the present invention, there is provided a novel cutoff assembly means for a vertical form, fill and seal packaging machine. The cutoff assembly has a pair of cutoff blades held horizontally in the packaging machine. One of the blades is fixed in position, while the other blade is aligned therewith and movable to cutoff a plurality of formed lower pouches from upper pouches. The movable blade is preferably floating, and includes adjusting means to move it in a horizontal direction.

BRIEF DESCRIPTION OF THE DRAWINGS

The objects and features of the present invention, which are believed to be novel, are set forth in particularity in the appended claims. The present invention, both as to its organization and manner of operation, together with further objects and advantages, may best be understood by reference to the following description taken in connection with the accompanying drawings, in which:

DESCRIPTION OF THE PREFERRED EMBODIMENTS

The following description is provided to enable any person skilled in the art to make and use the invention and sets forth the best modes contemplated by the inventor to carry out his invention. Various modifications, however, will remain readily apparent to those skilled in the art, since the generic principles of the present invention have been defined herein specifically to provide for a novel and improved cutoff assembly means for a form, fill and seal packaging machine.

Figure 1:
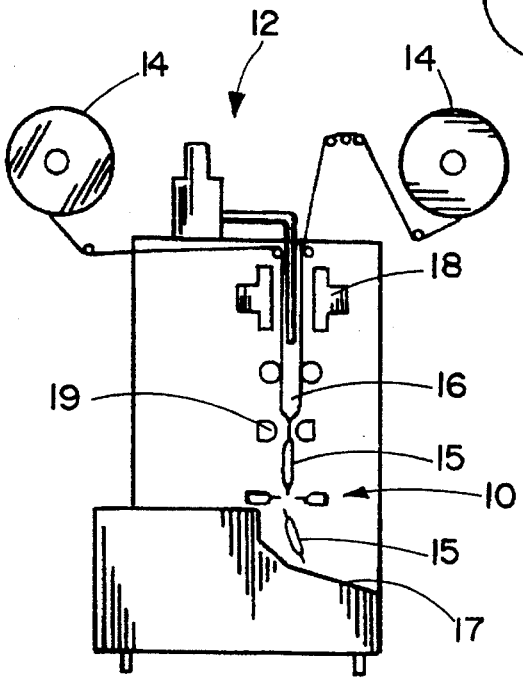
FIG. 1 is a schematic front elevational view of a representational form, fill and seal packaging machine having a cutoff assembly of the present invention mounted therein.

Turning now to the drawings, there shown is an improved and novel cutoff knife assembly means 10 preferably for use in horizontally cutting off packages or pouches, after such pouches are formed, filled and sealed, in a known manner, in a vertical packaging machine, such as shown at 12 in FIG. 1. Machine 12 uses a pair of rolls of heat sealable plastic film 14, mounted at the top of the machine. The film has a variety of widths and travels downwardly (vertically) through the machine, toward the bottom, to simultaneously form, fill and seal pouches 15, in a plurality of streams. The finally formed pouches 15, which may hold any of a variety of viscous food for use elsewhere, are then cut off from upper, partially formed pouches 16 at the end of their vertical or downward travel through the machine, by the cutoff means 10.

Basically, as shown in FIG. 1, after being formed, filled and sealed, a plurality of formed lower pouches 15, extending horizontally across the machine 12, when looking at the drawing, are cut off. These formed lower pouches 15 are secured to endless streams of the flexible rolls of film 14, heat sealed together and filled in the machine, and then horizontally cut off by the knife cutoff assembly 10 from the partially formed upper pouches 16, so as to form the independent pouches 15 which are discharged from machine 12 at the lowest point 17, thereof. The novel knife cutoff assembly 10 of the present invention is placed downstream (vertically) in the machine 12, and horizontally cuts off a plurality of formed pouches 15, after the pouches are formed by side seal means 18 and the head seal 19, which slit the material 14 and form the side, bottom and top cross seals in the pouches 15 before they are finally cut off by the cutoff means 10.

Figure 4:
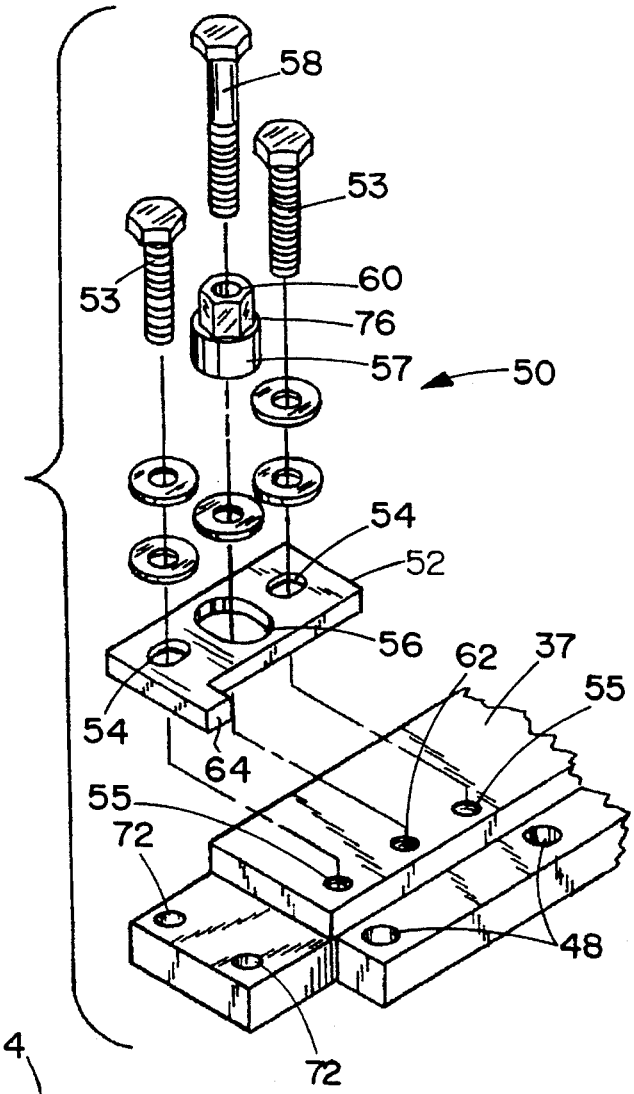
FIG. 4 is an enlarged partial exploded isometric view of one end of the cutoff assembly means of FIG. 2 showing details of one of the cutoff blade adjusting means.
Figure 2:
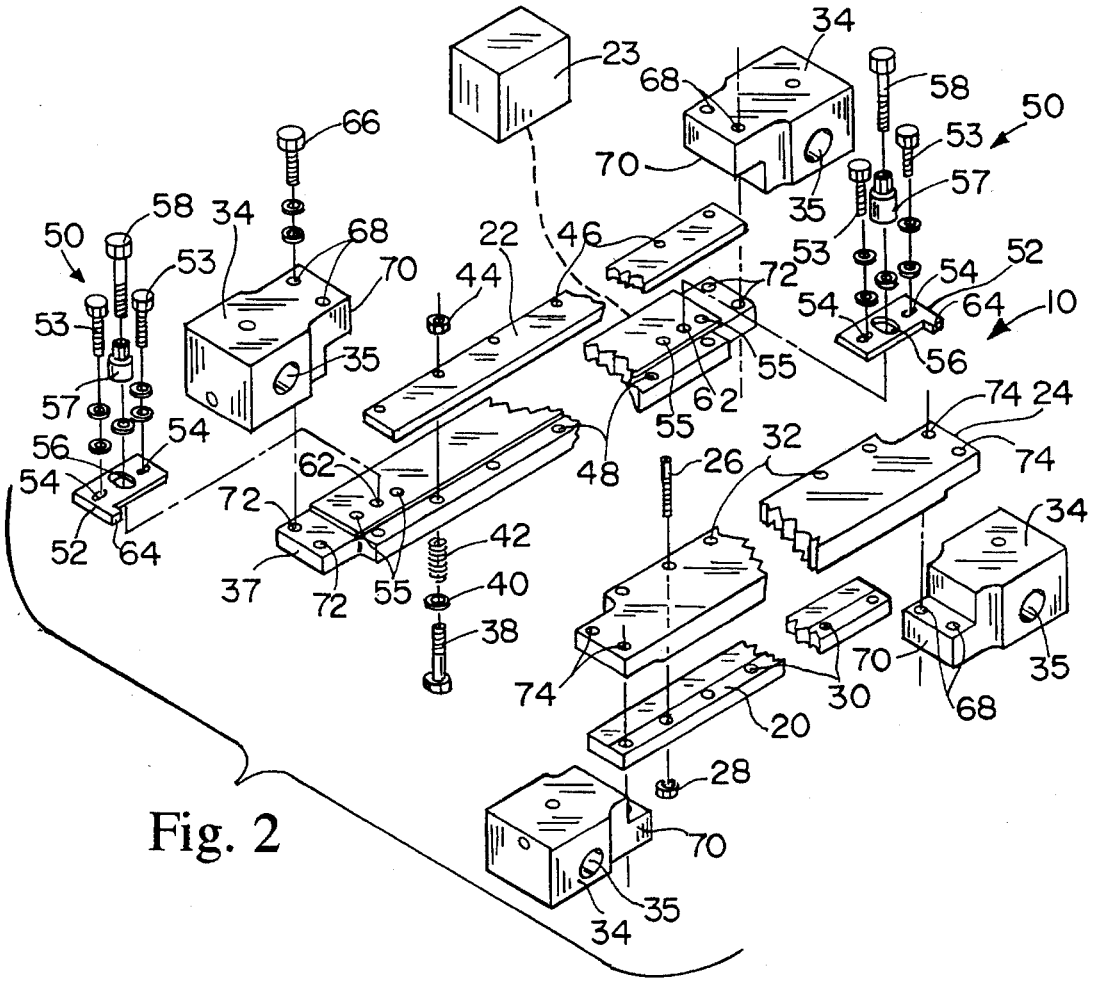
FIG. 2 is a partial exploded isometric view of a cutoff assembly means in accordance with the present invention.
Figure 3:
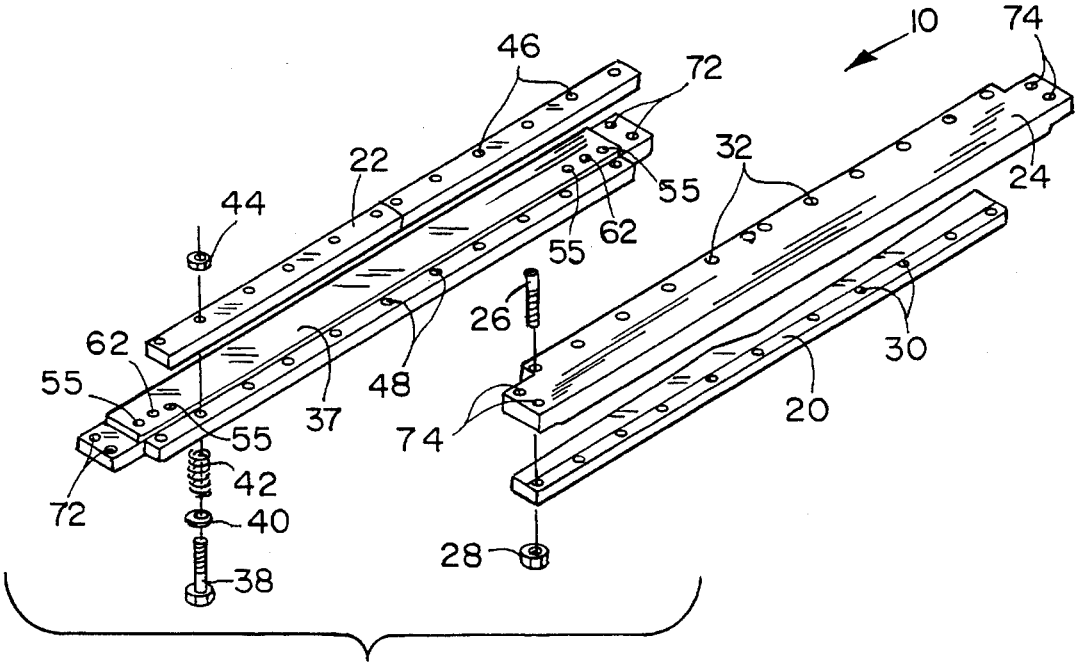
FIG. 3 is a further partial exploded isometric view of the cutoff blades and holding means of FIG. 2.

Turning now to FIGS. 2, 3 and 4, there shown are the main components of the novel knife cutoff means assembly 10 of the present invention. These include a fixed cutoff blade or knife 20 and a movable cutoff blade or knife 22. The fixed knife 20 is preferably secured to a first holding means, such as a strongback 24, by a plurality securing means 26, 28, such as screws and nuts, which pass through a plurality of aligned openings 30, 32 formed through the strongback 24 and knife 20, so as to secure the knife 20 in a position where it will cooperate with knife 22. The strongback 24 is preferably immovably secured in the machine 12 by holding means, such as slideblocks 34, secured to the ends of the strongback 24 and held in the machine by any desired securing means. The slideblocks 34 include openings 35 through which slide shafts (not shown) may travel to guide the movable knife 22 toward the fixed knife 20.

The movable knife 22 is in turn mounted to a second strongback 37 by a plurality of securing means, such as a plurality of bolts 38, washers 40, springs 42 and nuts 44, passing through a plurality of aligned openings 46, 48 formed through the knife 22 and the strongback 37. This securing means, particularly the springs 42, allows the movable knife 22 to float in the vertical direction, with respect to the machine 12 and fixed blade 20. The strongback 37, with the knife 22 secured thereto is secured to slideblocks 34, slidably held in the machine, as by means of openings 35 having slide shafts therein. The movable knife 22, second strongback 37, and slideblocks 34, when assembled and secured together, are operated in a known manner by operating means 23, such as a hydraulic cylinder operatively connected to the strongback 37 to reciprocate the knife 22 into contact with fixed knife 20.

Upon operation of the blade 22, hard to cut materials, not normally cut with known cutting means in known form, fill and seal packaging machines, may be accurately and positively cut. The floating or vertical movement of the movable blade 22 is adjusted by loosening or tightening the nut and bolts holding the blade 22 to the strongback 37, so as to compress or loosen the spring 42 so as to allow more or less play therein, in a known manner.

Additionally, since over time it has been found that all cutoff means, including the floating, movable knife 22 acting against a fixed knife 20, as shown and disclosed herein, will eventually become out of adjustment, the present invention also provides adjusting means 50, formed at both ends of the movable cutoff blade 22. This adjusting means 50 may be formed in any desirable manner, such as mechanical adjusting means comprised of mechanical means cooperating with the cutoff knife 22 and/or strongback 37 at either or both ends thereof. In the preferred embodiment of the invention, each end of the floating knife 22 is provided with adjustable positioning means 52 secured to the strongback 37 (see FIGS. 2 and 4). Securing means, such as a plurality of screws 53 passing through openings 54 in the positioning means 52 and secured within threaded openings 55 formed within the strongback 37, removably secure the positioning means in place. Additionally, the adjustable positioning means 52 includes an elliptically shaped central opening 56, having a cam means, such as an eccentric 57 rotatably mounted therein, as by means of a removable securing means, such as a bolt 58 passing through a central opening 60 (see FIG. 4) within eccentric 57 and secured within a further opening 62, preferably threaded, formed in the strongback 37. The adjustable positioning means 52 also includes an extending finger 64 which cooperates with an end of knife blade 22, for movement thereof, as described below.

As best shown in FIG. 2, each of the slideblocks 34 is secured to an end of either strongback 24 or 37 by securing means, such as threaded screws 66, passing through openings 68, formed in reduced thickness end portions 70, and secured within either threaded openings 72, formed at the ends of strongback 37, or threaded openings 74, formed at the ends of strongback 24.

When it is desired to adjust the knife 22, relative to the machine 12, the strongback 37 and the fixed cutting blade 20, the screws 53, 58 are loosened and a nut shaped portion 76, or similar type adjusting means secured to the eccentric 57, is turned. This turns the eccentric 57, so as to move the adjustable positioning means 52 and in turn, through the extending finger 64, move a cooperating end of the knife blade 22 abutting the finger portion 64. That is, by separately moving each of the adjustable positioning means 52 in the desired horizontal direction, by adjusting its respective eccentric element 57, each end of the knife blade 22 may be horizontally moved, to thereby accurately align the movable blade 22 with respect to the fixed blade 20, in the horizontal direction. Each of the adjusting means 50 at the ends of the movable knife blade 22 allow quick, accurate and precise adjustment of the blade 22 in the horizontal direction so as to produce the best possible pouches in the shortest period of time, without requiring special tools, and the dismantling of the entire packaging machine and/or the cutoff means thereon.

It, therefore, can be seen that the unique adjusting means in the novel cutoff means of the present invention provides an adjusting means which may be quickly and easily operated in such a manner that the down time of the packaging machine is minimized.

Those skilled in the art will appreciate that there are adaptations and modifications of the just described preferred embodiment can be configured without departing from the scope and spirit of the invention. Therefore, it is to be understood, that within the scope of the intended claims, the invention may be practiced other than as specifically described herein.

What is claimed is:

1. A cutoff assembly means adapted to be used in a packaging machine, to simultaneously cut off a plurality of collapsible dispenser pouches in a number of streams of pouches formed from thin films of sheet material traveling downwardly, in a vertical direction, from a top to a bottom of said packaging machine, and holding viscous food product formed, filled and sealed in said packaging machine, comprising, in combination:

a side seal means and a head seal means in said packaging machine;

a plurality of cutoff blades secured in said packaging machine, in a downstream direction, after said head seal means;

said plurality of cutoff blades including a fixed blade means and a movable blade means;

said fixed blade means being immovably secured in said packaging machine;

operating means for said movable blade means for slidable movement in said packaging machine, into and out of contact with said fixed blade means;

said fixed blade means and said movable blade means secured to holding means held in said packaging machine; and said movable blade means includes a plurality of adjustable means securing said movable blade means to a first holding means, whereby said entire movable blade means is floatable with respect to said first holding means.

2. The cutoff assembly means of claim 1 wherein said movable blade means includes two ends with further adjusting means cooperating with said two ends.

3. The cutoff assembly means of claim 2 wherein said further adjusting means is adapted to move said movable blade means in a horizontal direction, perpendicular to the direction of travel of formed collapsible pouches through said packaging machine.

4. The cutoff assembly means of claim 3 wherein said further adjusting means comprises mechanical means in contact with said two ends.

5. The cutoff assembly means of claim 4 wherein said mechanical means in contact with said two ends comprises separate cam means, adjustably mounted to said holding means for said movable blade means, for selectively moving said two ends.

6. The cutoff assembly means of claim 5 wherein said separate cam means include an eccentric rotatably mounted within an elliptical opening formed in a positioning means contacting one of said two ends whereby, upon rotation of said eccentric, said positioning means will allow the one of said two ends which it contacts to move in the horizontal direction.

7. The cutoff assembly means of claim 6 wherein said eccentric and said positioning means include adjustable securing means to lock said eccentric and said positioning means in place, when not adjusting said movable blade.

8. A combination packaging machine and cutoff assembly means, said packaging machine forming, filling and sealing a plurality of collapsible dispenser pouches in a number of streams of pouches from thin sheets of heat sensitive plastic material, traveling in a vertical direction, downwardly, from a top to a bottom of said packaging machine; said cutoff assembly means being mounted downwardly in said packaging machine, after a side seal means and a head seal means, and comprising:

a fixed blade means secured to a first holding means so as to be immovably secured in said packaging machine in a horizontal direction, perpendicular to the vertical direction of travel of said thin sheets of heat sensitive plastic material through said packaging machine;

a movable blade means fixed to a second movable holding means, slidably mounted in said packaging machine, in a horizontal direction, and movable by operating means into and out of contact with said fixed blade means to cut off a plurality of collapsible dispenser pouches formed, filled and sealed in said packaging machine; and a plurality of adjusting means cooperating with said movable blade means whereby said entire movable blade means is floatable with respect to said second movable holding means.

9. The combination packaging machine and cutoff assembly means of claim 8 wherein said movable blade means has two ends with further adjusting means cooperating with and adapted to move said movable blade means in a horizontal direction, perpendicular to the direction of travel of formed collapsible pouches through said packaging machine.

10. The combination packaging machine and cutoff assembly means of claim 9 wherein said further adjusting means comprises mechanical means in contact with said two ends.

11. The combination packaging machine and cutoff assembly means of claim 10 wherein said mechanical means in contact with said two ends comprises separate cam means, adjustably mounted to said second holding means for said movable blade means, for separately moving said two ends.

12. The combination packaging machine and cutoff assembly means of claim 11 wherein said separate cam means include an eccentric rotatably mounted within an elliptical opening formed in a positioning means contacting one of said two ends whereby, upon rotation of said eccentric, said positioning means will be moved to allow the one of said two ends which it contacts to move.

13. The combination packaging machine and cutoff assembly means of claim 12 wherein said eccentric and said positioning means include adjustable securing means to lock said eccentric and said positioning means in place, when not adjusting said movable blade.

14. The combination packaging machine and cutoff assembly means of claim 8 wherein said first holding means and said second holding means are secured to slideblocks having openings therein; said openings in said slideblocks adapted to hold guide shafts therein so as to insure proper registration of said movable blade means with said fixed blade means; and said movable blade means having two ends with separate mechanical adjusting means, secured to said second holding means, and contacting said two ends so as to selectively adjust said movable blade in said horizontal direction.

15. The combination packaging machine and cutoff assembly means of claim 14 wherein each of said separate mechanical adjusting means comprises a movable positioning plate in contact with one of said two ends and an eccentric rotatably mounted within an elliptical opening formed in said movable positioning plate.

16. A cutoff assembly for a packaging machine which forms, fills and seals collapsible pouches from materials traveling downwardly, in a vertical direction, from a top towards a bottom of said packaging machine; said cutoff assembly being mounted horizontally in said packaging machine, below a side seal means and a head seal means, and comprising, in combination:

a fixed blade, secured to a first strongback immovably held by a plurality of slideblocks in said packaging machine;

a movable blade, adjustably and floatably secured to a second strongback, for adjustable movement in both the horizontal and vertical directions with respect to said second strongback and said packaging machine;

said movable blade including two ends, and said second strongback including two separate adjusting means, comprising an eccentric rotatably mounted to said second strongback in a positioning plate, removably secured to said second strongback;

said positioning plate including a substantially elliptical opening formed therethrough with said eccentric captured therein, and a finger cooperating with one of said two ends of said movable blade, whereby upon rotation of said eccentric, said positioning plate may be moved to move the cooperating one of said two ends of said movable blade by said finger; and operating means for activating said movable blade into contact with said fixed blade so as to cut off any formed, collapsible pouches between said fixed blade and said movable blade.

* * * * *